US005168888A

United States Patent [19]

Altwasser

[11] Patent Number: 5,168,888

[45] Date of Patent: Dec. 8, 1992

[54] GOLF CLUB CLEANING APPARATUS

[76] Inventor: Arlie A. Altwasser, 443 Assiniboia Street, Weyburn, Saskatchewan, Canada, S4H 0R5

[21] Appl. No.: 795,471

[22] Filed: Nov. 21, 1991

[51] Int. Cl.[5] ..... B08B 3/02

[52] U.S. Cl. ..... 134/181; 134/199; 134/200; 134/201

[58] Field of Search ..... 134/182, 183, 172, 200, 134/199, 181, 201, 135

[56] References Cited

U.S. PATENT DOCUMENTS

| | | | |
|---|---|---|---|
| 1,246,556 | 11/1917 | Crow | 134/180 X |
| 1,765,647 | 6/1930 | Boehnke | 134/153 |
| 2,563,652 | 8/1951 | Le Gore | 134/180 X |
| 3,101,089 | 8/1963 | Brown et al. | 134/180 X |
| 3,538,927 | 11/1970 | Wallgren | 134/180 X |
| 3,872,534 | 3/1975 | Hoag . | |
| 4,069,536 | 1/1978 | Hartz et al. . | |
| 4,380,839 | 4/1983 | Caradonna . | |
| 4,472,851 | 9/1984 | Kinsey . | |
| 4,541,138 | 9/1985 | Varrial . | |
| 4,676,839 | 6/1987 | Osborn . | |
| 4,750,230 | 6/1988 | Osborn . | |
| 4,757,831 | 7/1988 | Ingermann et al. | 134/102 |
| 4,821,358 | 4/1989 | Wyckoff et al. . | |
| 4,944,063 | 7/1990 | Jordan . | |
| 4,951,339 | 8/1990 | Braun . | |

*Primary Examiner*—Frankie L. Stinson

*Attorney, Agent, or Firm*—Adrian D. Battison; Stanley G. Ade; Murray E. Thrift

[57] ABSTRACT

A golf club cleaning machine includes a cabinet within which is mounted a drum. Inside the outer drum is mounted an inner drum formed from a perforated mesh material with an inner wall and an outer wall defining an annular cavity which is divided by radial walls into separate compartments. Each club of a set is inserted into a respective one of the compartments with the handle supported longitudinally of the compartment and the club head mounted at the base of the compartment with the club face facing inwardly and the underside facing generally outwardly. A rotating spray system is mounted in the base of the drum including an inner spray nozzle and an outer spray nozzle each rotatable about a central axis of the spray system. The inner spray nozzle sprays onto the club face generally inwardly and slightly downwardly and the outer spray nozzle sprays onto the club rear in a direction generally opposite to the inner nozzle. A rubber gasket at the top of the compartment seals the compartment and provides a simple slots through which the club head can be inserted.

7 Claims, 4 Drawing Sheets

GOLF CLUB CLEANING APPARATUS

BACKGROUND OF THE INVENTION

This invention relates to an apparatus for cleaning golf clubs using a spray jet system.

Various apparatus have been proposed for cleaning golf balls, cleaning golf club handles and even for cleaning golf club heads. The proper care of equipment is important to the golfer for the purpose of maintaining accuracy of stroke and proper flight of the ball.

Many courses provide apparatus for cleaning the golf ball. However the face of the club is also of significant importance but few if any golf courses provide apparatus to assist the golfer in maintaining his clubs in proper clean and effective condition.

A number of previous patents in this field have been revealed and provide apparatus for cleaning golf clubs.

U.S. Pat. Nos. 4,951,339 (Braun), U.S. Pat. No. 4,676,839 (Osborn), U.S. Pat. No. 4,944,063 (Jordan), U.S. Pat. No. 4,821,358 (Wyckoff), U.S. Pat. No. 4,472,851 (Kinsey), U.S. Pat. No. 4,380,839 (Caradonna), U.S. Pat. No. 3,872,534 Hoag), U.S. Pat. No. 4,069,536 (Hartz) and U.S. Pat. No. 4,541,138 (Varrial) disclose arrangements for cleaning the head of a golf club using a brush arrangement so that the head is moved by the user into position within the device for actuation of the brushes on the head. The patent to Varrial discloses a conveyor arrangement which moves each club in turn along a track for a cleaning action by a brushing arrangement.

In most cases the cleaning action acts upon a single club which is inserted into the rotating brush arrangement.

It is believed that the above arrangements are not effective due to the fact that the manual agitation or power brushes exert stress on the clubs. Many power driven apparatus of this type are not safe for use by the general public as there is significant force on the club while it is being held by the user.

The cleaning action of a single club at a time is disadvantageous in that the user will need a significant amount of time to clean all of the clubs within his bag.

U.S. Pat. No. 4,750,230 (Osborn) discloses an arrangement for cleaning the golf club grip area in which a plurality of the golf clubs are simultaneously inserted into a container and the grips cleaned by a brushing action.

SUMMARY OF THE INVENTION

It is one object of the present invention to provide a safe, simple, economical and efficient means of cleaning golf clubs within a reasonable time span.

It is a further object of the present invention to provide a device of this type which may be installed at a pro shop or the main traffic area near or around the club house of the golf course so that the device can be used by the golfer on a regular basis conveniently and simply for a reasonable cost.

A device of this design can enable the general golfing public to wash their clubs at their own convenience before or after a game of golf. There is no necessity therefore for the golfer himself to own or acquire a cleaner of this type and hence the machine can be of a type which is relatively expensive and large to provide an effective and safe cleaning action with little or no manual effort by the user. Such a machine therefore can provide a cleaning action which is as easy as removing and replacing the clubs in the golf bag.

According to a first aspect of the invention there is provided an apparatus for cleaning a golf club having a handle, a shaft and a club head including a club face and a club rear, the apparatus comprising wall means defining a receptacle for receiving and supporting the golf club, a first spray jet and a second spray jet, means mounting the first spray jet relative to the receptacle so as to spray cleaning fluid onto the club face of the club within the receptacle and means mounting the second spray jet relative to the receptacle so as to spray cleaning fluid onto the club rear of the club while in the receptacle.

According to a second aspect of the invention there is provided an apparatus for cleaning a set of golf clubs each having a handle, a shaft and a club head, the apparatus comprising wall means defining a plurality of receptacles each for receiving a respective one of the clubs and spray jet means for spray cleaning fluid onto the club head of each of the clubs for cleaning the set of clubs.

According to a third aspect of the invention there is provided an apparatus for cleaning a set of golf clubs each having a handle, a shaft and a club head, the apparatus comprising wall means defining a plurality of receptacles each for receiving a respective one of the clubs and spray jet means for spray cleaning fluid onto the club head of each of the clubs for cleaning the set of clubs, wherein the receptacles are arranged side by side, wherein there is provided means for moving the jet means from each receptacle to a next adjacent receptacle such that each of the clubs is cleaned in turn by movement of the jet means, wherein the receptacles are arranged in the form of a cylinder surrounding a central axis, wherein the jet means rotates around the axis, wherein there is provided a first jet arranged inside the cylinder facing outwardly and a second jet arranged outside the cylinder facing inwardly for cleaning the club or head from an inside and outside respectively, wherein the cylinder is formed from an inner wall and an outer wall and a plurality of dividing walls arranged substantially radially, and wherein at least the inner and outer walls are formed from a perforated material so as to provide support for the club head while allowing the penetration of said cleaning fluid therethrough.

The apparatus can be designed to clean left or right handed clubs including irons and woods of any loft equally at the same time. The ability to clean a complete set or most of the set at a single time in a convenient time span is particularly important since this enables the device to be used quickly and effectively by a number of golfers passing the equipment at the golf course. The equipment can be coin freed so as to cover the costs for the golf course or to make a profit as required.

The device provides a cleaning action using a high pressure spray action of the type used in a car wash system using a high pressure pump and motor of the type readily commercially available for such systems. The pump and spray nozzles arranged to spray high pressure liquid via a flexible stainless steel hose to a pair of jet nozzles arranged to clean the face, back, heel and toe of the golf club head.

The spray nozzles can be rotated upon the liquid supply tubes around a cylindrical array of the clubs mounted in respective receptacles with one nozzle mounted outside the cylindrical array spraying inwardly onto the clubs and the second nozzle arranged inside the cylindrical array and spraying outwardly onto the club head. The nozzles can be rotated around the cylindrical array by a reversing gear motor and timer relay. The switching from clockwise to counter-clockwise rotation at predetermined intervals provides a proper cleaning action across the full surface of the club head. The cylindrical array of receptacles can be formed from a mesh material mounted within an outer imperforate retaining tank for collection of the liquid passing through the mesh material. The inner and outer mesh cylinders are divided into separate substantially rectangular receptacles by radially extending dividers thus forming sleeves into which the golf clubs can be inserted and are supported with the club head at the base of the receptacle.

An upper face of the receptacles can be closed by a rubber gasket or cover which has a plurality of slits with each slit being associated with a respective one of the receptacles so that the golf club head can pass through the slit and then the slit close around the shaft to provide an effective seal to prevent the escape of spray or debris.

The machine therefore provides an effective cleaning action in a manner which enables the machine to be located at or near the club house or pro shop. It is believed that no such cleaning machine is currently available but that there is a significant demand for cleaning which is currently carried out mainly by manual cleaning action after the clubs are returned home. There is therefore believed to be a significant opportunity for profit either by the club or by a franchise operator handling and maintaining the machines at different clubs.

One or more embodiments of the invention will now be described in conjunction with the accompanying drawings.

BRIEF DESCRIPTION OF THE DRAWINGS

In the drawings like characters of reference indicate corresponding parts in the different figures.

DETAILED DESCRIPTION

Figure 1:
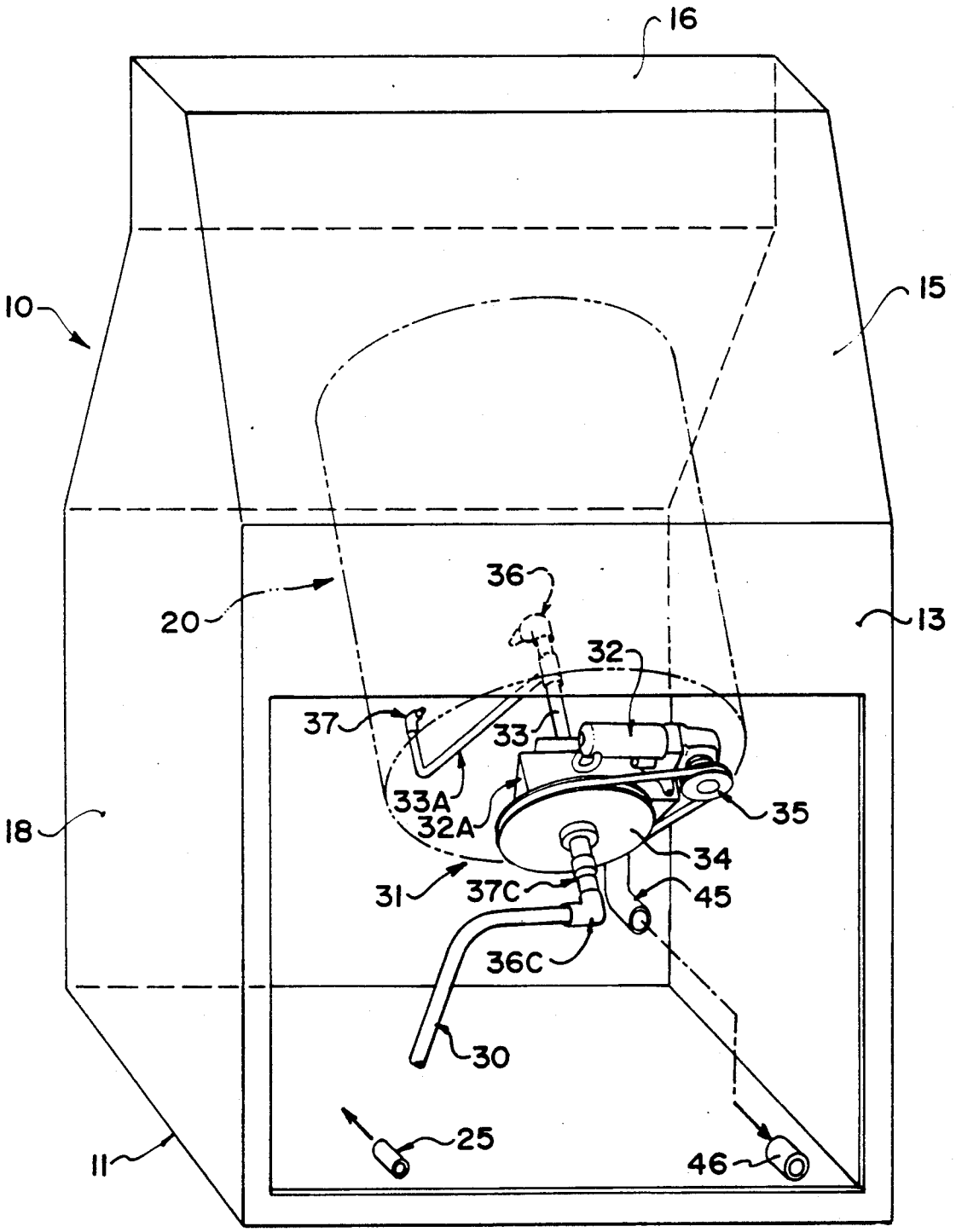
FIG. 1 is a rear isometric view showing a golf club cleaning apparatus according to the present invention including showing in phantom the interior construction thereof.
Figure 2:
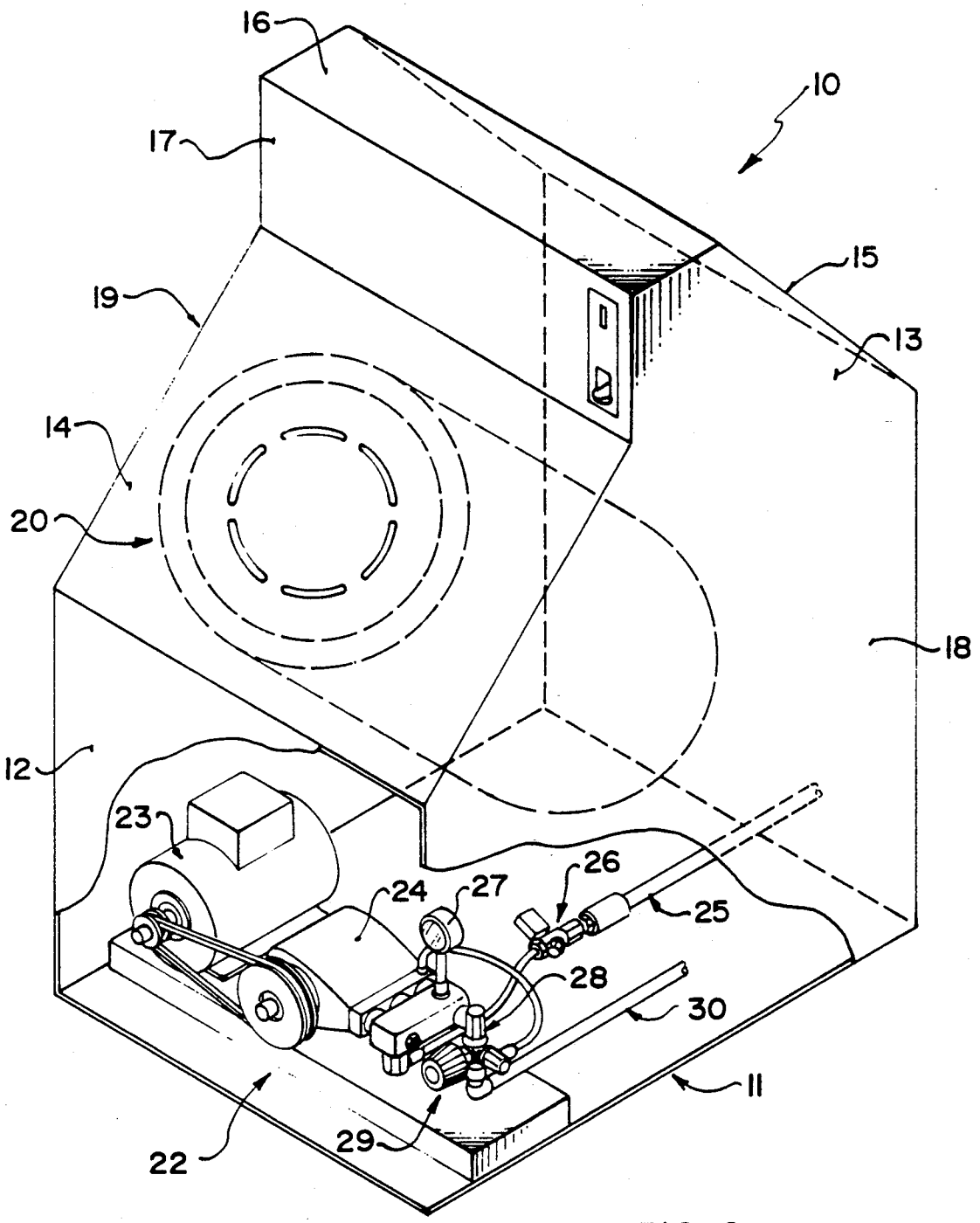
FIG. 2 is an isometric view showing the golf club cleaning apparatus of FIG. 1 showing a front and one side and showing the interior parts partly in phantom.

Referring firstly to the complete apparatus as shown in FIGS. 1 and 2, there is provided a cabinet generally indicated at 10 which is self contained and includes all of the parts necessary for operation of the golf club cleaning apparatus.

The cabinet 10 includes a base 11 for resting upon a suitable support surface. The cabinet further includes a vertical front panel 12, a vertical rear panel 13, an upwardly and rearwardly inclined front panel 14, an upwardly and forwardly inclined rear panel 15, a top panel 16 which is horizontal and a front panel 17 which is vertical. The cabinet is closed by side panels 18 and 19 which are shaped to cooperate with the side edges of the front and rear panels together with the top panel 16.

The inclined front panel 14 provides access to a cleaning drum generally indicated at 20 described in more detail hereinafter. The vertical front panel 17 includes a coin freed mechanism 21 which allows the device to be actuated on receipt of the necessary money. The coin freed mechanism can be replaced by a simple switch in cases where no money is to be collected.

Within the housing 10 is provided a pump section generally indicated at 22 including a motor drive 23 and a pump 24 driven from the motor drive 23. The pump receives input water from an input line 25 having a connection at the rear of the housing for receiving water from a conventional water supply. Downstream of the water supply 25 is provided a valve system 26 which can be actuated to allow the supply of water into the pump 24 to be pressurized within the pump to a high pressure of the type of pressure available in a car wash system which can be up to 1000 lbs/in$^2$. The pump includes a guage 27 for manual inspection. The outlet from the pump is supplied on a line 28 to a control valve system 29 for variation of the pump pressure to a required pressure which can be of the order of 500 lbs./in$^2$. The pump assembly 22 is mounted in a forward part of the cabinet underneath the drum 20.

An outlet for the pressurized fluid from the valve 29 is provided by a pipe 30 which is connected from the pump assembly to an injection assembly shown in FIG. 1 and generally indicated at 31. The injection assembly, includes a drive motor 32 mounted upon a fixed support 32A at the base of the drum 20. The fixed support carries a main duct 33 which is rotatable about a longitudinal axis of the main duct 33. The main duct 33 is connected to a drive disc 34 which is rotated about the longitudinal axis of the duct 33 by the motor 32 via a pulley drive system 35 mounted on the motor 32. The main duct 33 is coupled to the supply duct 30 by an elbow 36C and by a swivel connection 37C which allows the duct 33 to rotate relative to an end portion fixedly connected to the elbow 36C. The main duct 33 carries a first cleaning jet 36 and a second cleaning jet 37, the first being mounted on the duct 33 and the second carried by an arm portion 33A of the main duct so that each cleaning jet receives the high pressure liquid from the supply duct 30 and each is rotated about the longitudinal axis of the main duct 33.

Figure 3:
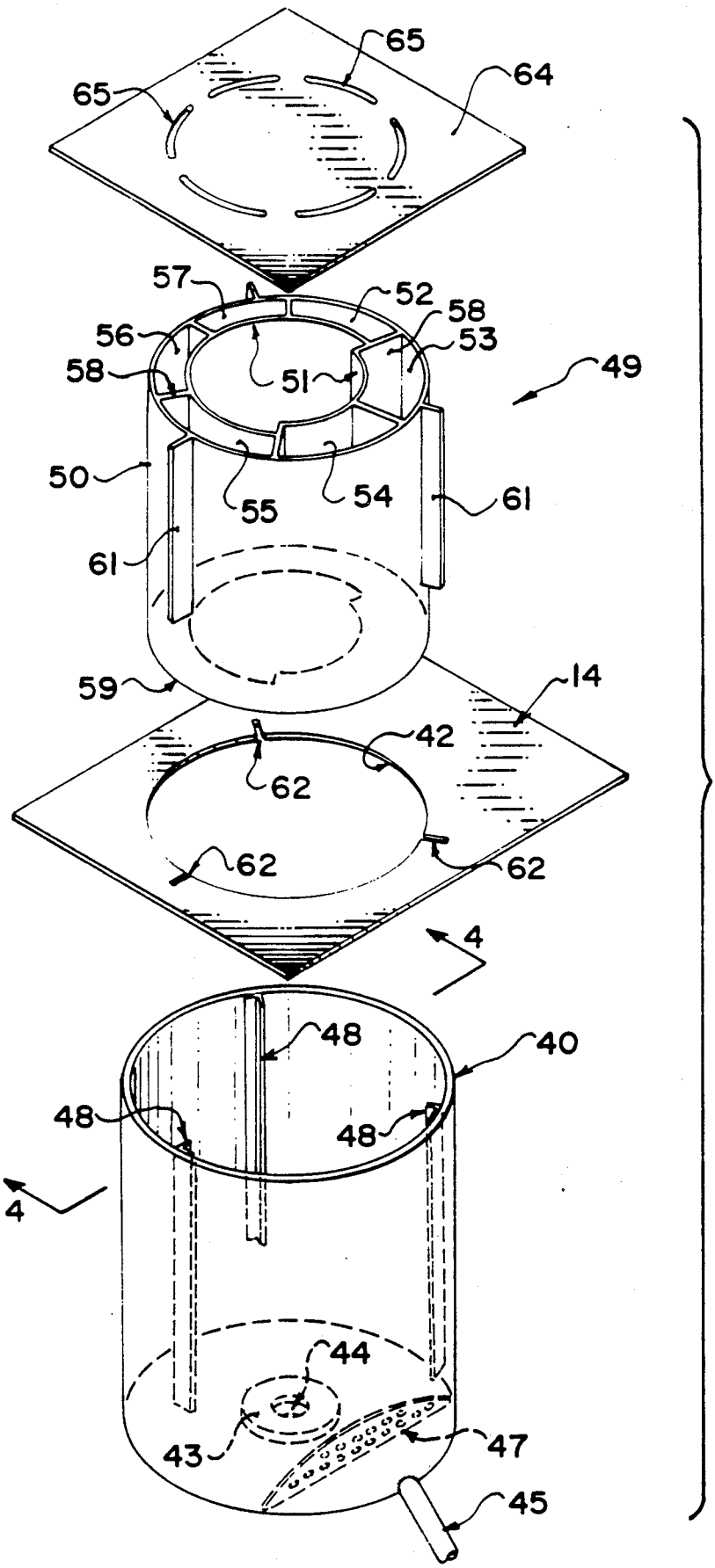
FIG. 3 is an exploded view showing the construction of the cleaning drum of the apparatus of FIGS. 1 and 2.
Figure 4:
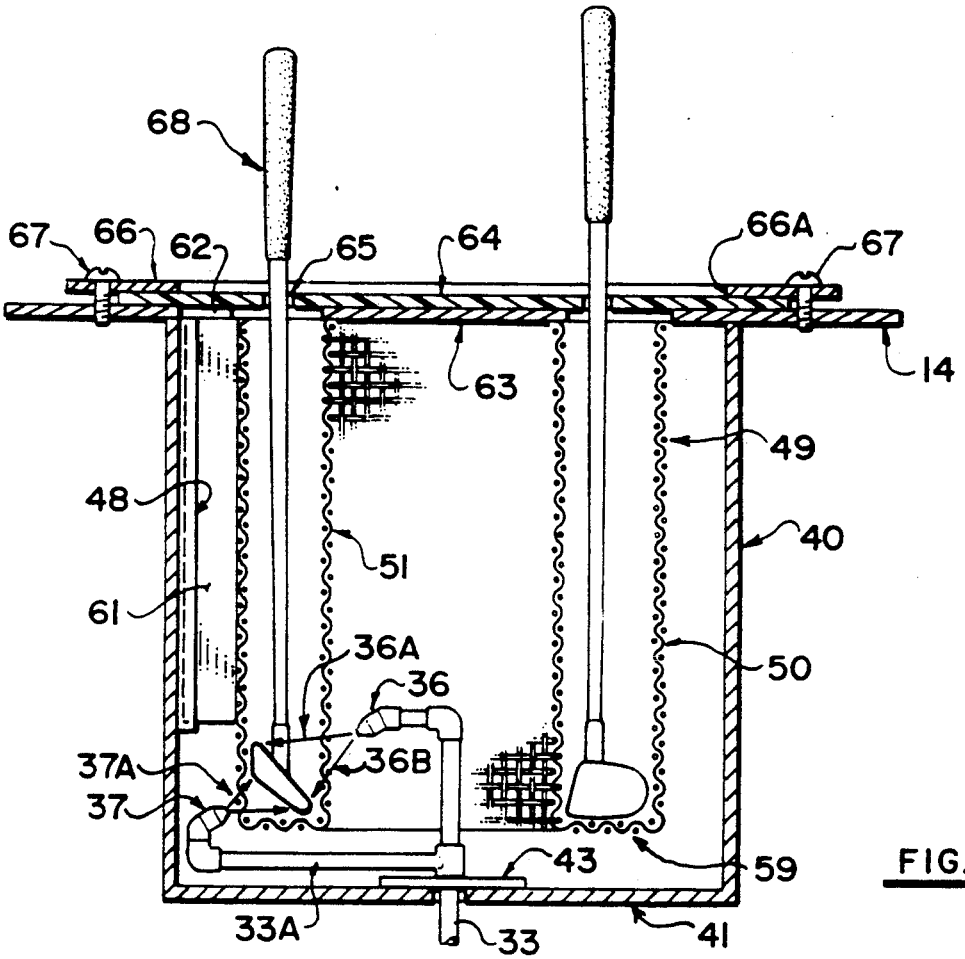
FIG. 4 is a cross sectional view along the lines 4—4 of FIG. 3.
Figure 5:
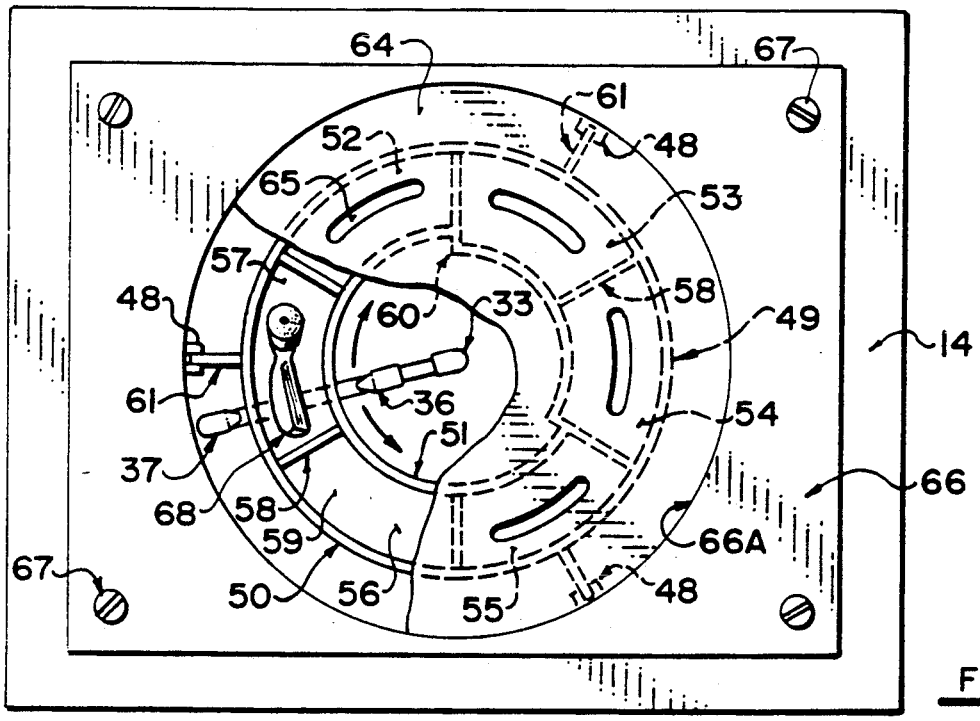
FIG. 5 is a top plan view of the part shown in FIG. 4 partly broken away to show the construction of the drum.

The construction of the drum is shown in more detail in FIGS. 3, 4 and 5. The drum thus comprises a solid or imperforate outer drum 40 including a cylindrical drum wall and a base 41. The cylindrical wall 40 is welded to a top plate 14 which is constituted by the inclined front wall of the cabinet. The plate 14 includes an opening 42 which is circular to allow access through the plate into the drum. The diameter of the opening 42 is slightly less than the diameter of the wall of the drum 40.

At the base of the drum is provided a seal member 43 which allows the duct 33 to pass through an interior opening 44 of the seal while preventing the escape of water from the seal. The details of the seal are shown only schematically as these are well known to one skilled in the art. At the base of the drum is provided a drain opening or duct 45 which communicates with an outlet duct 46 at the outer wall of the cabinet to allow water entering the drum to drain naturally to waste. A perforated plate 47 is provided inside the drum at the opening to the duct 45 to act as a filter to prevent blockage of the outlet duct 45.

On the inside surface of the drum wall 40 is provided three equiangularly spaced guide grooves 48 which define a vertical groove into which a vertical flange can extend for supporting an inner drum member 49. The guide grooves 48 terminate at a position spaced above the base 41 of the outer drum so as to support the inner drum at a required depth within the outer drum spaced from the base 41.

The inner drum 49 comprises an outer wall 50 and an inner wall 51 which are substantially coaxial so as to define an annular chamber therebetween. The annular chamber is divided into a number of separate compartments 52, 53, 54, 55, 56, 57 by radially extending dividing walls 58. The inner wall 51, the outer wall 50 and the dividing walls 58 are all formed from a mesh material which allows readily the penetration of cleaning fluid particularly in a spray action. The base of each of compartment is closed by a bottom wall 59. Thus each compartment comprises an elongate separate compartment extending substantially from the base 59 to an open top of the mesh inner drum.

As best shown in FIGS. 3 and 5, two of the compartments indicated at 53 and 54 are dimensioned larger than the other compartments by a step 60 in the inner wall 51 so that the inner wall at the compartment 53 and 54 is moved radially inwardly to increase the width of those compartments. Thus the compartments are dimensioned so that four of the compartments can receive the conventional "iron" golf club while the two larger compartments can receive the "wood" golf clubs.

The inner drum 49 is supported in the outer drum 40 by flanges 61 which project outwardly from the outer wall of the inner drum each for cooperation with a respective one of the groove guides 48. In addition the plate 14 at the opening 42 includes slots 62 which are aligned with the groove guides 48 so that the inner drum can slide into place by aligning the flanges 61 with the groove 62 and sliding the flanges downwardly until the flanges meet the bottom of the groove guides to hold the drum supported within the outer drum.

At the top of the inner wall 51 is provided a transverse support plate 63 which is circular and sits on top of the inner wall 51.

On top of the plate 14 is provided a rubber gasket 64 which covers the opening 42 in the plate 14. The rubber gasket 64 fully covers the opening and thus fully covers the outer and inner drums and the plate 63. The gasket includes a plurality of angularly extending slots 65 each of which is arranged over a respective one of the compartments 51 through 57.

On top of the rubber gasket is attached a further plate 66 which clamps by machine screws 67 onto the plate 14 to hold the rubber gasket in place. The plate 66 includes an opening 66A exposing a central part of the rubber gasket allowing access to the slot 65.

As best shown in FIG. 4, the cleaning jet 36 is positioned inside the inner wall 51 and directing the spray along a fan pattern 36A at an approximately 45 degree angle toward the inner wall and particularly toward an inner face 36B of an iron club 68 positioned in a respective one of the compartments and generally at right angles to the face 36B. The spray jet 36 is arranged so that the spray 36A engages the club face 36B adjacent the bottom edge of the club face but is directed upwardly across the club face to provide a cleaning action across the full width of the club face.

The spray jet 37 is positioned effectively symmetrically relative to the spray jet 36 so as to spray in a fan pattern indicated at 37A toward the underside of the club with the jet angled slightly upwardly toward the underface of the club generally in a direction opposite to the pattern 36A and approximately at right angles to the rear face of the club.

In operation, a user of the cleaning apparatus will take his club set and introduce the clubs into the cleaning apparatus with each club being placed into a respective one of the receptacles so as to stand upright in the receptacle with the club handle guided by the slot 65 in the rubber gasket and the club head at the base of the receptacle resting upon the bottom wall 59. The club is placed with the club face facing inwardly and the rear of the club head facing outwardly. It does not matter therefore whether the club is left handed or right handed since the required orientation can be selected before the club is placed through the slot 65.

Once all of the clubs are positioned within the cleaning apparatus, the coin freed mechanism 21 or switch is actuated to commence the cleaning action. During the cleaning action the pump 24 is operated to generate high pressure liquid spray for communication to the spray jets 36 and 37. At the same time the control valve 26 is electrically operated to allow the communication of fluid to the pump. Simultaneously the motor 32 is actuated to drive the disc 34 and therefore the spray nozzles 36 and 37 in one direction around the axis of the duct 33. As the disc 34 rotates, the spray nozzles move from each compartment to the next around the axis of a duct 33 to clean each club in turn. The angle of the spray from the spray nozzles 36 and 37 are shown along the arrows 36A and 37A respectively to provide an effective cleaning action for any material resting upon the upper or lower surfaces of the club head. However it is desirable in order to obtain a complete cleaning action that the direction of rotation of the disc 34 is periodically changed so the spray passes over the clubs from firstly a clockwise rotation and subsequently a counter clockwise rotation. The motor 32 therefore includes a reversing system controlled by a timer associated with the coin freed switch mechanism schematically indicated at 21. In one example the cleaning device can operate for a period of two minutes with a change in direction every twenty seconds with the disc 34 rotating at a speed so that during the twenty seconds it rotates approximately six or seven times. In this way a full cleaning action is obtained over the whole of the club head for both the irons and the woods and for both left handed and right handed clubs.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. An apparatus for cleaning a set of golf clubs each having a handle, a shaft and a club head, the apparatus comprising a housing, wall means mounted within the housing and defining a plurality of elongate receptacles each for receiving the club head and at least part of the shaft of a respective one of the clubs and spray jet means for spray cleaning fluid onto the club head of each of the clubs for cleaning the set of clubs, said wall means comprising a first inner substantially cylindrical wall surrounding a central axis, a second coaxial outer substantially cylindrical wall surrounding the first and defining an annular chamber therebetween, an annular base interconnecting the inner and outer walls and a plurality of radially extending dividing walls thus forming said receptacle at spaced positions around said axis such that each receptacle is substantially rectangular and is confined by the inner wall, the outer wall, the base and two spaced dividing walls, at least the inner and outer walls being formed from a perforated material so as to provide support for the club head while allowing the penetration of said cleaning fluid therethrough, the wall means being fixed relative to the housing, drive means for moving the jet means in a circular path around said central axis from each receptacle to a next adjacent receptacle such that each of the clubs is cleaned in turn by movement of the jet means, the spray jet means including inner jet means mounted inside the inner wall facing outwardly to spray upon the heads of the clubs through the inner wall and outer jet means mounted outside the outer wall facing inwardly to spray upon the heads of the clubs through the outer wall, said drive means being arranged to rotate the jet means about the central axis on alternate clockwise and counterclockwise directions for predetermined intervals.

2. The apparatus according to claim 1 wherein the inner spray jet is arranged to project said cleaning fluid onto a club face of the club head in a direction substantially at right angles thereto.

3. The apparatus according to claim 1 wherein the inner and outer jet means are arranged to spray the cleaning fluid at a pressure of at least five hundred pounds per square inch.

4. The apparatus according to claim 1 including a coin freed mechanism and means for actuating said spray jets in response to supply of a coin to the coin freed mechanism.

5. The apparatus according to claim 1 wherein each receptacle includes a cover having an opening therein through which the club head can pass.

6. The apparatus according to claim 5 wherein the cover is formed from a flexible material and includes a slit therein defining said openings.

7. The apparatus according to claim 1 wherein one of the inner and outer substantially cylindrical walls includes a recessed portion thereof such that the plurality of receptacles includes first receptacles and second receptacles with the first receptacles being arranged at the recessed portion so as to be larger in dimension for receiving woods and the second receptacles being smaller in dimension for receiving irons.

* * * * *